US010280592B2

(12) United States Patent
Takahashi et al.

(10) Patent No.: US 10,280,592 B2
(45) Date of Patent: May 7, 2019

(54) HYDRAULIC DRIVE SYSTEM FOR ELECTRICALLY-OPERATED HYDRAULIC WORK MACHINE

(71) Applicant: HITACHI CONSTRUCTION MACHINERY TIERRA CO., LTD., Shiga (JP)

(72) Inventors: Kiwamu Takahashi, Koka (JP); Shingo Kishimoto, Koka (JP); Yoshifumi Takebayashi, Koka (JP); Kazushige Mori, Koka (JP); Natsuki Nakamura, Koka (JP)

(73) Assignee: Hitachi Construction Machinery Tierra Co., Ltd., Shiga (JP)

( * ) Notice: Subject to any disclaimer, the term of this patent is extended or adjusted under 35 U.S.C. 154(b) by 177 days.

(21) Appl. No.: 15/376,863

(22) Filed: Dec. 13, 2016

(65) Prior Publication Data

US 2017/0089038 A1 Mar. 30, 2017

Related U.S. Application Data

(63) Continuation of application No. 14/346,120, filed as application No. PCT/JP2012/076968 on Oct. 18, 2012.

(30) Foreign Application Priority Data

Oct. 20, 2011 (JP) ..... 2011-231174

(51) Int. Cl.
*E02F 9/20* (2006.01)
*E02F 9/22* (2006.01)
(Continued)

(52) U.S. Cl.
CPC ..... *E02F 9/207* (2013.01); *E02F 3/325* (2013.01); *E02F 9/2095* (2013.01);
(Continued)

(58) Field of Classification Search
CPC ..... F15B 9/03; F15B 9/04; F15B 2211/6651; F15B 2211/6652
(Continued)

(56) References Cited

U.S. PATENT DOCUMENTS 5,155,996 A * 10/1992 Tatsumi ..... E02F 9/2235 417/34
5,307,631 A * 5/1994 Tatsumi ..... E02F 9/2228 60/452
(Continued)

FOREIGN PATENT DOCUMENTS

EP 2 752 586 A1 7/2014
JP 03-051502 A 3/1991
(Continued)

OTHER PUBLICATIONS

International Preliminary Report on Patentability received in International Application No. PCT/JP2012/076968 dated May 1, 2014.
(Continued)

*Primary Examiner* — Michael Leslie
*Assistant Examiner* — Matthew Wiblin
(74) *Attorney, Agent, or Firm* — Mattingly & Malur, PC

(57) ABSTRACT

An electrically-operated hydraulic work machine drives an actuator with a hydraulic pump driven by an electric motor and exercises load sensing control by controlling the rotation speed of the electric motor. The useful life of an electrical storage device, which is an electrical power source for the electric motor, is increased by suppressing the horsepower consumption of the hydraulic pump. This prolongs the operating time of the electrically-operated hydraulic work machine, and reduces the size of the electric motor. A controller exercises load sensing control over a variable displacement main pump by controlling the rotation speed of the electric motor, and provides the main pump with a torque
(Continued)

control device that reduces the delivery rate of the main pump when the delivery pressure of the main pump increases, or provides the controller with a control algorithm that performs the same function as the torque control device.

5 Claims, 8 Drawing Sheets

(51) Int. Cl.

| | |
|---|---|
| ***F15B 11/16*** | (2006.01) |
| ***F04B 35/04*** | (2006.01) |
| ***E02F 3/32*** | (2006.01) |
| ***F15B 13/06*** | (2006.01) |
| *E02F 3/96* | (2006.01) |

(52) U.S. Cl.
CPC ..... *E02F 9/2235* (2013.01); *E02F 9/2296* (2013.01); *F04B 35/04* (2013.01); *F15B 11/16* (2013.01); *F15B 11/165* (2013.01); *F15B 13/06* (2013.01); *E02F 3/964* (2013.01); *F15B 2211/20515* (2013.01); *F15B 2211/20538* (2013.01); *F15B 2211/20546* (2013.01); *F15B 2211/255* (2013.01); *F15B 2211/30555* (2013.01); *F15B 2211/6055* (2013.01); *F15B 2211/6309* (2013.01); *F15B 2211/6313* (2013.01); *F15B 2211/6651* (2013.01); *F15B 2211/6652* (2013.01); *F15B 2211/71* (2013.01); *F15B 2211/76* (2013.01)

(58) Field of Classification Search
USPC ..... 60/414, 431
See application file for complete search history.

(56) References Cited

U.S. PATENT DOCUMENTS

| | | | | |
|---|---|---|---|---|
| 7,513,110 | B2 * | 4/2009 | Tatsuno | B60W 10/06 417/22 |
| 8,534,264 | B2 * | 9/2013 | Kawaguchi | E02F 9/2075 123/350 |
| 2005/0071064 | A1 * | 3/2005 | Nakamura | F02D 29/04 701/50 |
| 2007/0119163 | A1 * | 5/2007 | Tatsuno | B60W 30/18072 60/493 |
| 2011/0238264 | A1 * | 9/2011 | Wu | B60K 6/485 701/36 |

FOREIGN PATENT DOCUMENTS

| | | | | | |
|---|---|---|---|---|---|
| JP | 05-079502 | A | | 3/1993 | |
| JP | 07-127605 | A | | 5/1995 | |
| JP | H07127493 | A | * | 5/1995 | E02F 9/2235 |
| JP | H07127493 | A | | 5/1995 | |
| JP | 2008-256037 | A | | 10/2008 | |
| JP | 2011-017427 | A | | 1/2011 | |
| JP | 2011-017431 | A | | 1/2011 | |
| JP | 2011-021688 | A | | 2/2011 | |
| JP | 2011-190072 | A | | 9/2011 | |
| WO | 2010/030830 | A1 | | 3/2010 | |
| WO | 2011/004879 | A1 | | 1/2011 | |

OTHER PUBLICATIONS

Extended European Search Report received in corresponding European Application No. 12841517.1 dated Oct. 7, 2015.

* cited by examiner

Present invention

Prior art

HYDRAULIC DRIVE SYSTEM FOR ELECTRICALLY-OPERATED HYDRAULIC WORK MACHINE

CROSS REFERENCE TO RELATED APPLICATION

This application is a continuation application of Ser. No. 14/346,120, filed Mar. 20, 2014, the entirety of the contents and subject matter of all of the above is incorporated herein by reference.

TECHNICAL FIELD

The present invention relates to a hydraulic drive system for a hydraulic excavator or other electrically-operated hydraulic work machine that performs various types of work by driving an actuator with a hydraulic pump driven by an electric motor. More specifically, the present invention relates to a load sensing hydraulic drive system for controlling the delivery rate of a hydraulic pump in such a manner that the delivery pressure of the hydraulic pump is higher than the highest load pressure by a predetermined pressure.

BACKGROUND ART

An electrically-operated hydraulic work machine, such as a hydraulic excavator, that performs various types of work by driving an actuator with a hydraulic pump driven by an electric motor is described in Patent Document 1. The electrically-operated hydraulic work machine described in Patent Document 1 includes a fixed displacement hydraulic pump driven by an electric motor, and exercises load sensing control by controlling the rotation speed of the electric motor in such a manner that a pressure difference is maintained constant between the delivery pressure of the hydraulic pump and the highest load pressure of a plurality of hydraulic actuators.

PRIOR ART LITERATURE

Patent Document

Patent Document 1: JP, A 2008-256037

SUMMARY OF THE INVENTION

Problems to be Solved by the Invention

The hydraulic drive system described in Patent Document 1 can exercise load sensing control by controlling the rotation speed of an electric motor without using a variable displacement pump that provides complex flow control. Therefore, a load sensing system can be easily mounted, for instance, in a small-size hydraulic excavator.

However, the hydraulic drive system described in Patent Document 1 uses the fixed displacement hydraulic pump. Therefore, when the delivery pressure of the hydraulic pump is maximized, the displacement of the hydraulic pump is at its maximum and remains unchanged. Hence, when the rotation speed of the electric motor is controlled to its maximum level due to load sensing, the delivery rate of the hydraulic pump is maximized so that the horsepower consumption of the hydraulic pump increases to a value indicated by the product of the maximum delivery pressure and the maximum delivery rate. As a result, the output horsepower of the electric motor increases to increase the electrical power consumption. In this instance, the electrical power consumption for cooling the electric motor also increases, thereby increasing the amount of discharge from a battery (electrical storage device), which is an electrical power source for the electric motor. This causes a problem in which the battery rapidly becomes exhausted to shorten the operating time of the work machine.

Further, the output of the electric motor needs to be determined in consideration of the maximum horsepower consumption of the hydraulic pump. This causes another problem in which an electric motor having a high output is required.

An object of the present invention is to provide a hydraulic drive system that is capable of not only increasing the operating time of an electrically-operated hydraulic work machine by suppressing the horsepower consumption of a hydraulic pump to increase the useful life of an electrical storage device, which is an electrical power source for an electric motor, but also reducing the size of the electric motor when used for the electrically-operated hydraulic work machine that drives an actuator with the hydraulic pump driven by the electric motor and exercises load sensing control by controlling the rotation speed of the electric motor.

Means for Solving the Problems (1) In accomplishing the above object, according to an aspect of the present invention, there is provided a hydraulic drive system for an electrically-operated hydraulic work machine. The work machine has an electric motor, a hydraulic pump driven by the electric motor, a plurality of actuators driven by a hydraulic fluid discharged from the hydraulic pump, a plurality of flow control valves for controlling the flow rate of the hydraulic fluid supplied from the hydraulic pump to the actuators, and an electrical storage device for supplying electrical power to the electric motor. The hydraulic drive system includes an electric motor rotation speed control system and a torque control device. The electric motor rotation speed control system exercises load sensing control to control the rotation speed of the hydraulic pump in such a manner that the delivery pressure of the hydraulic pump is higher than the highest load pressure of the actuators by a target differential pressure. The torque control device exercises control to prevent an absorption torque of the hydraulic pump from exceeding a predefined maximum torque by decreasing the delivery rate of the hydraulic pump when the delivery pressure of the hydraulic pump increases.

As described above, the torque control device, which exercises control to prevent the absorption torque of the hydraulic pump from exceeding the predefined maximum torque by decreasing the delivery rate of the hydraulic pump when the delivery pressure of the hydraulic pump increases, is included in addition to the electric motor rotation speed control system, which exercises load sensing control. Therefore, the horsepower consumption of the hydraulic pump is suppressed to reduce the electrical power consumption of the electric motor. This makes it possible to increase the useful life of the electrical storage device, which is an electrical power source for the electric motor. As a result, the operating time of the electrically-operated hydraulic work machine can be prolonged. Further, as the electrical power consumption of the electric motor is reduced, it is possible to reduce the size of the electric motor.

(2) According to another aspect of the present invention, there is provided the hydraulic drive system as described in (1) above, wherein the electric motor rotation speed control system includes a first pressure sensor for detecting the delivery pressure of the hydraulic pump, a second pressure sensor for detecting the highest load pressure, an inverter for controlling the rotation speed of the electric motor, and a controller. The controller includes a load sensing control computation section that computes a virtual displacement of the hydraulic pump, which increases or decreases depending on whether a differential pressure deviation between the difference between the delivery pressure of the hydraulic pump and the highest load pressure and a target LS differential pressure is positive or negative, in accordance with the delivery pressure and the highest load pressure, which are detected by the first and second pressure sensors, and with the target LS differential pressure, computes a target flow rate of the hydraulic pump by multiplying the virtual displacement by a reference rotation speed, and outputs a control command to the inverter for the purpose of controlling the rotation speed of the electric motor in such a manner that the delivery rate of the hydraulic pump agrees with the target flow rate.

As described above, a concept of the virtual displacement of the hydraulic pump is introduced into the load sensing control computation section to determine the target flow rate of load sensing control and exercise load sensing control by controlling the rotation speed of the electric motor. This makes it easy to improve the performance of load sensing control based on electric motor rotation speed control (see (4) and (5) below).

(3) According to yet another aspect of the present invention, there is provided the hydraulic drive system as described in (1) or (2) above, wherein the hydraulic pump is a variable displacement hydraulic pump; and wherein the torque control device is a regulator incorporated in the hydraulic pump.

Consequently, a smaller-size hydraulic pump can be used than when a hydraulic pump regulator is used to exercise load sensing control.

(4) According to still another aspect of the present invention, there is provided the hydraulic drive system as described in (2) above, wherein the hydraulic pump is a fixed displacement hydraulic pump; wherein the torque control device is configured to exercise one function of the controller incorporated herein; and wherein the controller further includes a torque limit control computation section that, in accordance with the delivery pressure of the hydraulic pump, which is detected by the first pressure sensor, computes a virtual displacement limit value that decreases with an increase in the delivery pressure of the hydraulic pump, and determines a new virtual displacement by selecting either the virtual displacement computed by the load sensing control computation section or the virtual displacement limit value, whichever is smaller, and computes the target flow rate of the hydraulic pump by multiplying the new virtual displacement by the reference rotation speed.

Consequently, as the hydraulic pump is of a fixed displacement type, the size of the hydraulic pump can be reduced to conserve space.

(5) According to an additional aspect of the present invention, there is provided the hydraulic drive system as described in (2) or (4) above, further including an operating device that designates the reference rotation speed, wherein the controller sets the reference rotation speed in accordance with a designation signal from the operating device, and computes the target LS differential pressure and the target flow rate in accordance with the reference rotation speed.

Consequently, when an operator manipulates the operating device to reduce the reference rotation speed, the target LS differential pressure and the target flow rate both decrease. As this reduces changes in the rotation speed of the electric motor and decreases the rotation speed of the electric motor, an excellent micromanipulation capability is obtained.

Effect of the Invention

In an electrically-operated hydraulic work machine that not only drives an actuator by driving a hydraulic pump with an electric motor, but also exercises load sensing control by controlling the rotation speed of the electric motor, control is exercised to prevent the absorption torque of the hydraulic pump from exceeding a predefined maximum torque by decreasing the delivery rate of the hydraulic pump when the delivery pressure of the hydraulic pump increases. This makes it possible to suppress the horsepower consumption of the hydraulic pump, reduce the electrical power consumption of the electric motor, and increase the useful life of an electrical storage device that serves as an electrical power source for the electric motor. As a result, the operating time of the electrically-operated hydraulic work machine can be prolonged. Further, as the electrical power consumption of the electric motor is reduced, it is possible to reduce the size of the electric motor. Moreover, the size of a cooling system for the electric motor can also be reduced because the size of the electric motor can be reduced.

MODE FOR CARRYING OUT THE INVENTION

Embodiments of the present invention will now be described with reference to the accompanying drawings.

First Embodiment

~Configuration~

Figure 1:
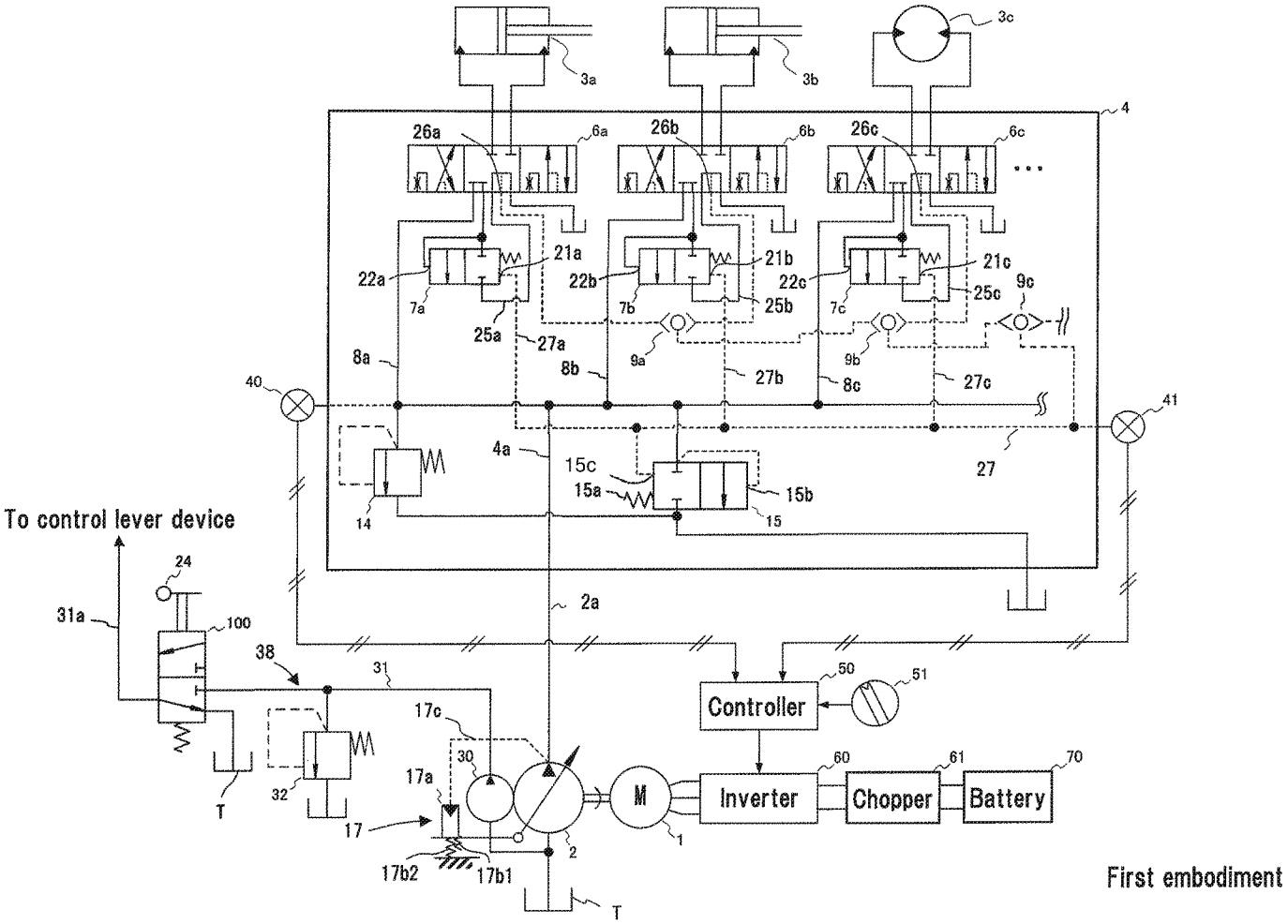
FIG. 1 is a diagram illustrating the configuration of a hydraulic drive system according to a first embodiment of the present invention that is used for an electrically-operated hydraulic work machine.

FIG. 1 is a diagram illustrating the configuration of a hydraulic drive system according to a first embodiment of the present invention that is used for an electrically-operated hydraulic work machine. The first embodiment relates to a case where the present invention is applied to the hydraulic drive system for a front swing type hydraulic excavator.

Referring to FIG. 1, the hydraulic drive system according to the present embodiment includes an electric motor 1, a variable displacement hydraulic pump (hereinafter referred to as the main pump) 2, a fixed displacement pilot pump 30, a plurality of actuators 3*a*, 3*b*, 3*c*, . . . , a control valve 4, a pilot hydraulic fluid source 38, and a gate lock valve 100. The main pump 2 and the fixed displacement pilot pump 30 are driven by the electric motor 1. The actuators 3*a*, 3*b*, 3*c*, . . . are driven by a hydraulic fluid discharged from the main pump 2. The control valve 4 is disposed between the main pump 2 and the actuators 3*a*, 3*b*, 3*c*, . . . . The pilot hydraulic fluid source 38 is connected to the pilot pump 30 through a pilot hydraulic line 31 to generate a pilot primary pressure in accordance with a fluid discharged from the pilot pump 30. The gate lock valve 100 is positioned downstream of the pilot hydraulic fluid source 38 to serve as a safety valve that is operated by a gate lock lever 24.

The control valve 4 includes a second hydraulic fluid supply line 4*a* (internal path), a plurality of closed-center flow control valves 6*a*, 6*b*, 6*c*, . . . , a plurality of pressure compensating valves 7*a*, 7*b*, 7*c*, . . . , a plurality of shuttle valves 9*a*, 9*b*, 9*c*, . . . , a main relief valve 14, and an unloading valve 15. The second hydraulic fluid supply line 4*a* is connected to a first hydraulic fluid supply line 2*a* (piping) to which the fluid discharged from the main pump 2 is supplied. The flow control valves 6*a*, 6*b*, 6*c*, . . . are connected to hydraulic lines 8*a*, 8*b*, 8*c*, . . . branched off from the second hydraulic fluid supply line 4*a*, and used to control the flow rate and direction of the hydraulic fluid to be supplied from the main pump 2 to the actuators 3*a*, 3*b*, 3*c*, . . . . The pressure compensating valves 7*a*, 7*b*, 7*c*, . . . are connected to hydraulic lines 25*a*, 25*b*, 25*c*, . . . , which connect a meter-in throttle section of the flow control valves 6*a*, 6*b*, 6*c*, . . . to a directional control section thereof, and used to control the downstream pressure of the meter-in throttle section of the flow control valves 6*a*, 6*b*, 6*c*, . . . until it is equal to a highest load pressure (described later). The shuttle valves 9*a*, 9*b*, 9*c*, . . . select the highest pressure (highest load pressure) from the load pressures of the actuators 3*a*, 3*b*, 3*c*, . . . , and output the selected highest pressure (highest load pressure) to a signal hydraulic line 27. The main relief valve 14 is connected to the second hydraulic fluid supply line 4*a* to prevent the pressure in the second hydraulic fluid supply line 4*a* (the delivery pressure of the main pump 2) from exceeding a preselected pressure. The unloading valve 15 is connected to the second hydraulic fluid supply line 4*a* into which the fluid discharged from the main pump 2 is introduced. When the delivery pressure of the main pump 2 is higher than a pressure obtained by adding a cracking pressure (the preselected pressure for a spring 15*a*) to the highest load pressure, the unloading valve 15 opens to return the fluid discharged from the main pump 2 to a tank T, thereby limiting an increase in the delivery pressure of the main pump 2.

The flow control valves 6*a*, 6*b*, 6*c*, . . . have load ports 26*a*, 26*b*, 26*c*, . . . , respectively. When the flow control valves 6*a*, 6*b*, 6*c*, . . . are in neutral position, the load ports 26*a*, 26*b*, 26*c*, . . . communicate with the tank T and output a tank pressure as a load pressure. When the flow control valves 6*a*, 6*b*, 6*c*, . . . are shifted from the neutral position to a left or right operating position (shown), the load ports 26*a*, 26*b*, 26*c*, . . . communicate with the actuators 3*a*, 3*b*, 3*c*, . . . , respectively and output the load pressures of the actuators 3*a*, 3*b*, 3*c*, . . . .

The shuttle valves 9*a*, 9*b*, 9*c*, . . . are connected to the load ports 26*a*, 26*b*, 26*c*, . . . in a tournament manner, and form a highest load pressure detection circuit together with the load ports 26*a*, 26*b*, 26*c*, . . . and the signal hydraulic line 27. In other words, the shuttle valve 9*a* selects either the pressure of the load port 26*a* of the flow control valve 6*a* or the pressure of the load port 26*b* of the flow control valve 6*b*, whichever is higher, and outputs the selected pressure. The shuttle valve 9*b* selects either the output pressure of the shuttle valve 9*b* or the pressure of the load port 26*c* of the flow control valve 6*c*, whichever is higher, and outputs the selected pressure. The shuttle valve 9*c* selects either the output pressure of the shuttle valve 9*b* or the output pressure of another similar shuttle valve (not shown), whichever is higher, and outputs the selected pressure. The shuttle valve 9*c* is a shuttle valve at a final stage. The output pressure of the shuttle valve 9*c* is output to the signal hydraulic line 27 as the highest load pressure. The highest load pressure output to the signal hydraulic line 27 is introduced into the pressure compensating valves 7*a*, 7*b*, 7*c*, . . . and the unloading valve 15 through signal hydraulic lines 27*a*, 27*b*, 27*c*, . . . .

The pressure compensating valves 7*a*, 7*b*, 7*c*, . . . include pressure receivers 21*a*, 21*b*, 21*c*, . . . , which operate in a closing direction and receive the highest load pressure from the shuttle valve 9*c* through the signal hydraulic lines 27, 27*a*, 27*b*, 27*c*, . . . , and pressure receivers 22*a*, 22*b*, 22*c*, . . . , which operate in an opening direction and receive the downstream pressure of the meter-in throttle section of the flow control valves 6*a*, 6*b*, 6*c*, . . . . The pressure compensating valves 7*a*, 7*b*, 7*c*, . . . exercise control so that the downstream pressure of the meter-in throttle section of the flow control valves 6*a*, 6*b*, 6*c*, . . . is equal to the highest load pressure. As a result, control is exercised so that the differential pressure across the meter-in throttle section of the flow control valves 6*a*, 6*b*, 6*c*, . . . is equal to the pressure difference between the delivery pressure of the main pump 2 and the highest load pressure.

The unloading valve 15 includes a spring 15*a*, a pressure receiver 15*b*, and a pressure receiver 15*c*. The spring 15*a* operates in a closing direction and sets the cracking pressure Pun0 of the unloading valve 15. The pressure receiver 15*b* operates in an opening direction and receives the pressure in the second hydraulic fluid supply line 4*a* (the delivery pressure of the main pump 2). The pressure receiver 15*c* operates in a closing direction and receives the highest load pressure through the signal hydraulic line 27. When the pressure in the hydraulic fluid supply line 4*a* is higher than a pressure obtained by adding the preselected pressure Pun0 for the spring 15*a* (cracking pressure) to the highest load pressure, the unloading valve 15 opens, returns the hydraulic fluid in the hydraulic fluid supply line 4*a* to the tank T, and exercises control so that the pressure in the hydraulic fluid supply line 4*a* (the delivery pressure of the main pump 2) is equal to a pressure obtained by adding the preselected pressure for the spring 15*a* and a pressure derived from the override characteristics of the unloading valve 15 to the highest load pressure. The override characteristics of the unloading valve are such that the inlet pressure of the unloading valve, namely, the pressure in the hydraulic fluid supply line 4*a*, increases with an increase in the flow rate of the hydraulic fluid returning to the tank through the unloading valve. In this document, the pressure obtained by adding the preselected pressure for the spring 15*a* and the pressure derived from the override characteristics of the unloading valve 15 to the highest load pressure is referred to as the unload pressure.

The actuators 3*a*, 3*b*, 3*c* are, for example, a boom cylinder, an arm cylinder, and a swing motor of a hydraulic excavator, respectively. The flow control valves 6*a*, 6*b*, 6*c* are, for example, a boom flow control valve, an arm flow control valve, and a swing flow control valve, respectively. For convenience of drawing, the other actuators, such as a bucket cylinder, a swing cylinder, and a travel motor, and flow control valves related to these actuators are not shown.

The pilot hydraulic fluid source 38 is connected to the pilot hydraulic line 31 and provided with a pilot relief valve 32 that maintains a constant pressure in the pilot hydraulic line 31. Manipulating the gate lock lever 24 can switch the gate lock valve 100 between a position for connecting a pilot hydraulic line 31*a* to the pilot hydraulic line 31 and a position for connecting the pilot hydraulic line 31*a* to the tank T.

The pilot hydraulic line 31*a* is connected to control lever devices 122, 123, 124 (see FIG. 4), which generate a command pilot pressure (command signal) for manipulating the flow control valves 6*a*, 6*b*, 6*c*, . . . to operate the associated actuators 3*a*, 3*b*, 3*c*, . . . . When the gate lock lever 24 is switched into the position for connecting the pilot hydraulic line 31*a* to the pilot hydraulic line 31, the control lever devices 122, 123, 124 regard the hydraulic pressure of the pilot hydraulic fluid source 38 as a primary pressure and generate the command pilot pressure (command signal) in accordance with the operation amount of each control lever. When, on the other hand, the gate lock valve 100 is switched into the position for connecting the pilot hydraulic line 31*a* to the tank T, the control lever devices 122, 123, 124 are unable to generate the command pilot pressure even if their control levers are manipulated.

In addition to the elements described above, the hydraulic drive system according to the present embodiment also includes a battery 70 (electrical storage device), a chopper 61, an inverter 60, a reference rotation speed designation dial 51 (operating device), a pressure sensor 40, a pressure sensor 41, and a controller 50. The battery 70 serves as an electrical power source for the electric motor 1. The chopper 61 boosts the DC power of the battery 70. The inverter 60 converts the DC power boosted by the chopper 61 to AC power and supplies the AC power to the electric motor 1. The reference rotation speed designation dial 51 is manipulated by an operator to designate the reference rotation speed of the electric motor 1. The pressure sensor 40 is connected to the hydraulic fluid supply line 4*a* of the control valve 4 to detect the delivery pressure of the main pump 2. The pressure sensor 41 is connected to the signal hydraulic line 27 to detect the highest load pressure. The controller 50 inputs a designation signal of the reference rotation speed designation dial 51 and detection signals of the pressure sensors 40, 41, and controls the inverter 60.

The chopper 61, the inverter 60, the reference rotation speed designation dial 51 (operating device), the pressure sensors 40, 41, and the controller 50 form an electric motor rotation speed control system that exercises load sensing control by controlling the rotation speed of the electric motor 1 and that of the main pump 2 in such a manner that the delivery pressure of the main pump 2 is higher than the highest load pressure of the actuators 3*a*, 3*b*, 3*c*, . . . by a target differential pressure.

Figure 2:
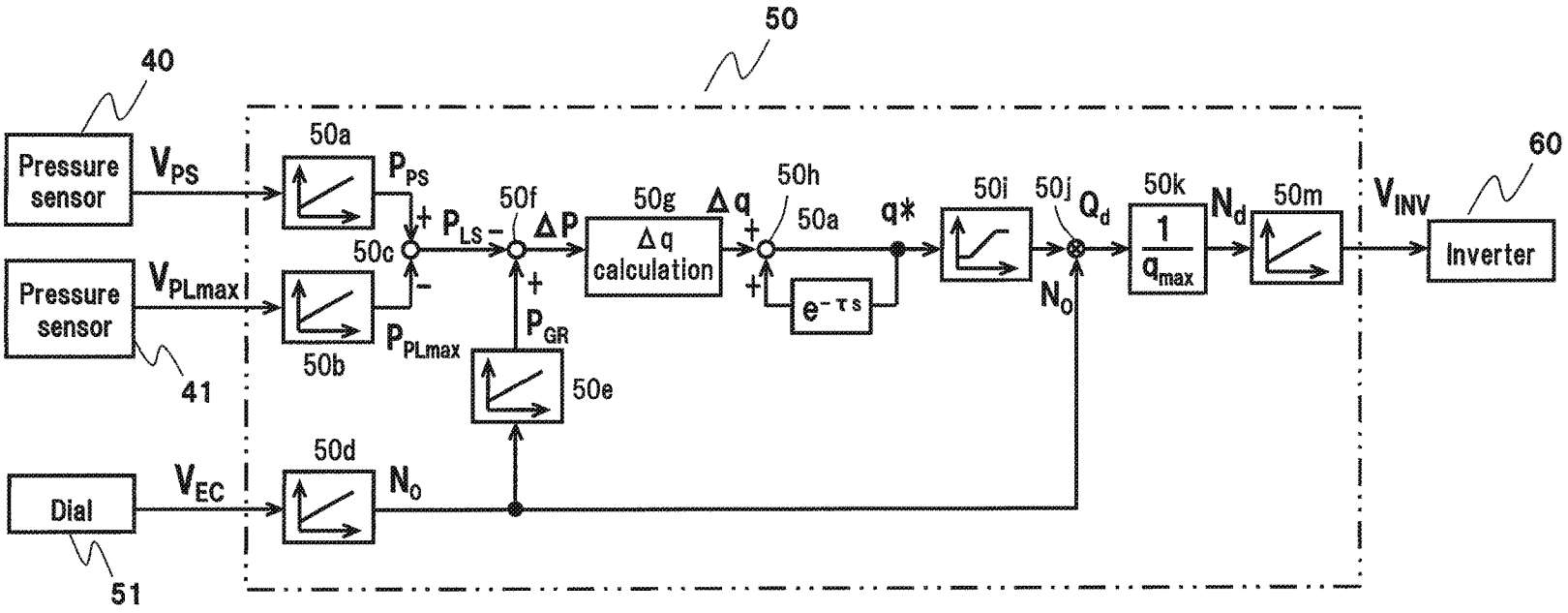
FIG. 2 is a functional block diagram illustrating processes performed by a controller 50.

FIG. 2 is a functional block diagram illustrating processes performed by the controller 50.

The controller 50 includes computation sections 50*a*-50*m* to perform various functions.

The computation sections 50*a*, 50*b* input the detection signals Vps, VPLmax of the pressure sensors 40, 41, respectively, and convert the input signals to the delivery pressure Pps of the main pump 2 and the highest load pressure PPLmax, respectively. Next, the computation section 50*c* determines the difference between the pressure Pps and the pressure PPLmax to calculate an actual load sensing differential pressure PLS (=Pps−PPLmax). Next, the computation section 50*d* converts the designation signal Vec of the reference rotation speed designation dial 51 to the reference rotation speed N0, and the computation section 50*e* converts the reference rotation speed N0 to a target LS differential pressure PGR.

The computation section 50*f* calculates a differential pressure deviation ΔP between the target LS differential pressure PGR and the actual load sensing differential pressure PLS. The computation section 50*g* calculates a change (increase/decrease) Δq in a virtual displacement q* of the main pump 2 from the differential pressure deviation ΔP. The computation section 50*g* is configured so that the virtual displacement change Δq increases with an increase in the differential pressure deviation ΔP. Further, the virtual displacement change Δq is calculated in such a manner that it is a positive value when the differential pressure deviation ΔP is positive and is a negative value when the differential pressure deviation ΔP is negative. The computation section 50*h* calculates a current virtual displacement q* by adding the virtual displacement change Δq to the virtual displacement q* prevailing one computation cycle earlier.

Here, the virtual displacement of the main pump 2 is a computed displacement value of the main pump 2 for controlling the rotation speed of the electric motor 1 in such a manner that the actual load sensing differential pressure PLS agrees with the target LS differential pressure PGR.

The computation section 50*i* performs a limiting process so that the obtained virtual displacement q* is within the range between a minimum displacement qmin and a maximum displacement qmax of the main pump 2 (not smaller than the minimum displacement qmin and not greater than the maximum displacement qmax).

The computation section 50*j* calculates a target flow rate Qd of the main pump 2 by multiplying the obtained virtual displacement q* by the reference rotation speed N0. The computation section 50*k* calculates a target rotation speed Nd of the main pump 2 by dividing the target flow rate Qd by the maximum displacement qmax of the main pump 2. The computation section 50*m* converts the target rotation speed Nd to a command signal (voltage command) Vinv, which is a control command for the inverter 60, and outputs the command signal Vinv to the inverter 60.

The computation sections 50*a*-50*c*, 50*f*-50*h* form a load sensing control computation section. In accordance with the delivery pressure Pps and the highest load pressure PPLmax, which are detected by the pressure sensors 41, 42, and with the target LS differential pressure PGR, the load sensing control computation section computes the virtual displacement q* of the main pump 2 that increases or decreases depending on whether the differential pressure deviation ΔP between the differential pressure PLS, which is the difference between the delivery pressure of the main pump 2 and the highest load pressure, and the target LS differential pressure PGR is positive or negative.

The hydraulic drive system according to the present embodiment further includes a torque control device 17 that exercises control to reduce the displacement of the main pump 2 in accordance with an increase in the delivery pressure of the main pump 2 for the purpose of preventing an absorption torque of the main pump 2 from exceeding a predefined maximum torque. The torque control device 17 is a regulator that is integral with the main pump 2 and provided with springs 17*b*1, 17*b*2 and a torque control tilt piston 17*a* to which the fluid discharged from the main pump 2 is introduced through a hydraulic line 17*c*.

Figure 3:
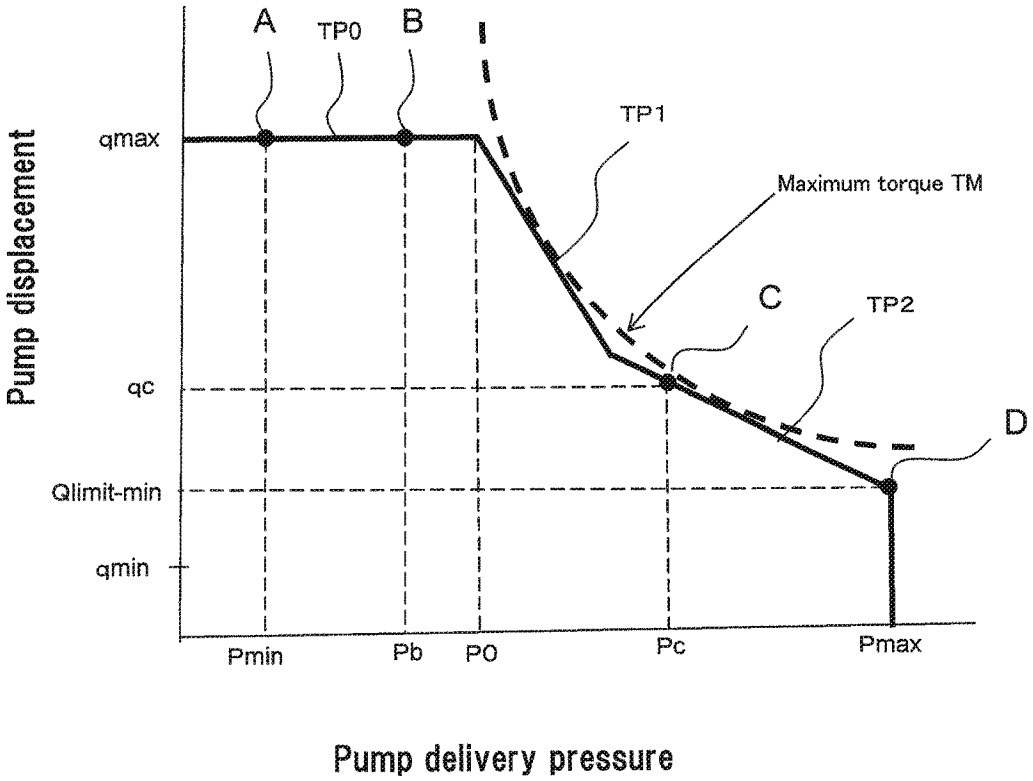
FIG. 3 is a diagram illustrating pump torque characteristics of a torque control device (Pq characteristics (pump delivery pressure-pump displacement characteristics)).

FIG. 3 is a diagram illustrating pump torque characteristics of the torque control device (Pq characteristics (pump delivery pressure-pump displacement characteristics)). The horizontal axis represents the delivery pressure of the main pump 2, and the vertical axis represents the displacement of the main pump 2. TP0 is a characteristics curve of the maximum displacement of the main pump 2. TP1 and TP2 are characteristics curves of torque control defined by the springs 17*b*1, 17*b*2. P0 is a predetermined pressure determined by the springs 17*b*1, 17*b*2 (a pressure at which constant absorption torque control is initiated).

When the delivery pressure of the main pump 2 is not higher than the predetermined pressure P0, the torque control tilt piston 17*a* of the torque control device 17 does not operate, and the displacement of the main pump 2 is represented by the maximum displacement qmax on the characteristics curve TP0. When the delivery pressure of the main pump 2 increases and exceeds the predetermined pressure P0, the torque control tilt piston 17*a* of the torque control device 17 operates, and the displacement of the main pump 2 decreases along the characteristics curves TP1, TP2 between the predetermined pressure P0 and a maximum delivery pressure Pmax of the main pump 2 (a preselected pressure for the main relief valve 14). As a result, control is exercised to maintain the absorption torque of the main pump 2 (the product of the pump delivery pressure and displacement) at a substantially constant value for the purpose of preventing the absorption torque from exceeding the maximum torque (limit torque) TM on the characteristics curves TP1, TP2. In this document, the above-mentioned control scheme is referred to as torque limit control, and a control scheme based on characteristics obtained when the displacement of the hydraulic pump is expressed in terms of delivery rate is referred to as horsepower control. The magnitude of the maximum torque TM can be freely set by selecting appropriate strengths of the springs 17*b*1, 17*b*2.

Figure 4:
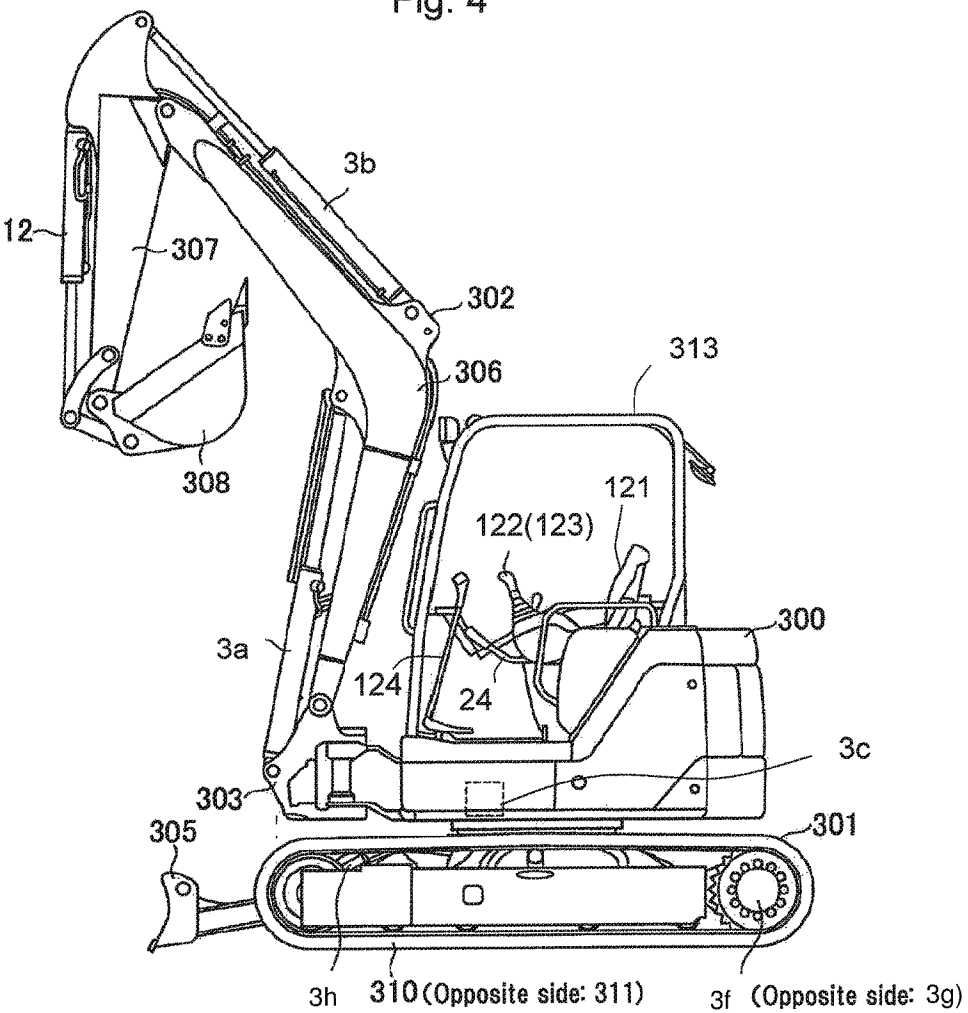
FIG. 4 is an external view of a hydraulic excavator in which the hydraulic drive system according to the first embodiment is mounted.

FIG. 4 is an external view of the hydraulic excavator in which the hydraulic drive system according to the present embodiment is mounted.

Referring to FIG. 4, the hydraulic excavator, which is well known as a work machine, includes an upper swing structure 300, a lower travel structure 301, and a swing-type front work implement 302. The front work implement 302 includes a boom 306, an arm 307, and a bucket 308. The upper swing structure 300 can swing the lower travel structure 301 by rotating the swing motor 3*c* shown in FIG. 1. A swing post 303 is mounted at the front of the upper swing structure 300. The front work implement 302 is vertically movably mounted on the swing post 303. The swing post 303 horizontally pivots with respect to the upper swing structure 300 when a swing cylinder (not shown) extends or contracts. The boom 306, arm 307, and bucket 308 of the front work implement 302 vertically pivot when the boom cylinder 3*a*, the arm cylinder 3*b*, and the bucket cylinder 12 extend or contract. The lower travel structure 301 is configured so that a blade 305, which vertically moves when a blade cylinder 304 extends or contracts, is mounted on a central frame. The lower travel structure 301 travels when travel motors 6, 8 rotate to drive left and right crawlers 310, 311. FIG. 1 shows only the boom cylinder 3*a*, the arm cylinder 3*b*, and the swing motor 3*c*, and does not show the bucket cylinder 3*d*, the left and right travel motors 3*f*, 3*g*, the blade cylinder 3*h*, and circuit elements thereof.

A cabin (cab) 313 is placed on the upper swing structure 300. The cabin 313 incorporates a cab seat 121, the front/swing control lever devices 122, 123 (only the device on the right side is shown in FIG. 4), the travel control lever device 124, and the gate lock lever 24.

~Operations~

Operations of the present embodiment will now be described.

<When the Control Levers are in Neutral Position>

When all operating devices, including the control levers of the control lever devices 122, 123, 124, are in neutral position, all the flow control valves 6*a*, 6*b*, 6*c*, are in neutral position. Therefore, the load ports 26*a*, 26*b*, 26*c*, . . . of the actuators 3*a*, 3*b*, 3*c*, . . . are connected to the tank so that the highest load pressure of the actuators 3*a*, 3*b*, 3*c*, . . . , which is detected by the shuttle valves 9*a*, 9*b*, 9*c*, . . . , is equal to the tank pressure. The tank pressure is detected by the pressure sensor 41.

Meanwhile, the electric motor 1 drives the main pump 2 to supply a hydraulic fluid to the hydraulic fluid supply lines 2*a*, 4*a*. The hydraulic fluid supply line 4*a* is connected to the flow control valves 6*a*, 6*b*, 6*c*, . . . , to the main relief valve 14, and to the unloading valve 15. When all the control levers are in neutral position, the flow control valves 6*a*, 6*b*, 6*c*, . . . are closed so that the delivery pressure of the main pump 2 rises to a pressure obtained by adding the pressure derived from the override characteristics to the preselected pressure for the spring 15*c* of the unloading valve 15.

Here, the preselected pressure of the unloading valve 15 is maintained constant by the spring 15*a*. The preselected pressure is higher than the target LS differential pressure PGR, which is calculated by the computation section 50*e* when the reference rotation speed N0 is maximized. If, for instance, the target LS differential pressure PGR is 2 MPa, the preselected pressure for the spring 15*a* is approximately 2.5 MPa and the delivery pressure (unload pressure) of the main pump 2 is approximately 2.5 MPa. The pressure sensor 40 connected to the hydraulic fluid supply line 4*a* detects the delivery pressure of the main pump 2. The delivery pressure of the main pump 2 is designated by Pmin.

As mentioned earlier, the detection signal of the pressure sensor 40 is Vps, and the detection signal of the pressure sensor 41 is VPLmax. The controller 50 calculates the virtual displacement q* of the main pump 2 in accordance with the detection signals Vps, VPLmax and with the designation signal Vec of the reference rotation speed designation dial 51, and then calculates the target flow rate Qd by multiplying the virtual displacement q* by the reference rotation speed N0. Further, the controller 50 calculates the target rotation speed Nd of the main pump 2 by dividing the target flow rate Qd by the maximum displacement qmax of the main pump 2, converts the target rotation speed Nd to the command signal Vinv for the inverter 60, and outputs the command signal Vinv to the inverter 60.

Here, as mentioned earlier, when all the control levers are in neutral position, the highest load pressure is equal to the tank pressure and the delivery pressure of the main pump 2 is higher than the target LS differential pressure PGR. Hence, as PLS=Pps−PPLmax=Pps>PGR, the differential pressure deviation ΔP (=PGR−PLS) computed in the controller 50 is a negative value so that the virtual displacement q* of the main pump 2 decreases. The minimum displacement qmin and the maximum displacement qmax are set in the computation section 50*i* with respect to the virtual displacement q* so that the virtual displacement q* decreases to the minimum displacement qmin and is held at the minimum displacement qmin. Consequently, the target flow rate Qd decreases to its minimum value. Further, the target rotation speed Nd of the main pump 2 and the command signal Vinv for the inverter 60 both decrease to their minimum values. As a result, the rotation speed of the electric motor 1 is held at its minimum value.

Meanwhile, the prevailing delivery pressure of the main pump 2 is Pmin as mentioned earlier. As Pmin<P0, the torque control tilt piston 17*a* of the torque control device 17 does not operate so that the displacement of the main pump 2 is at its maximum qmax. The resulting state is represented by point A in FIG. 3.

As described above, the displacement of the main pump 2 is maintained at the maximum displacement qmax. However, as the rotation speed of the electric motor 1 is held at its minimum value due to load sensing control exercised by controlling the rotation speed of the electric motor 1, the flow rate delivered by the main pump 2 is also held at its minimum value.

Here, when the minimum rotation speed of the electric motor 1 is Nmin, the following equations are obtained:

$$Qd=q\min\times N0=q\max\times N\min$$

$$N\min=N0\times(q\min/q\max)$$

In other words, when the resulting actual displacement of the main pump 2 is q and the controlled rotation speed of the electric motor 1 is N (hereinafter simply referred to as the rotation speed N), the actual displacement q, the virtual displacement q*, and the rotation speed N are expressed by the following equations:

$$q=q\max$$

$$q=q\min$$

$$N=N\min=N0\times(q\min/q\max)$$

<Independent Boom Raising (Light Load)>

When the control lever of a boom control lever device, which is either the control lever device 122 or the control lever device 123, is moved in a boom raising direction to perform a boom raising operation, a pilot pressure supplied from the pilot hydraulic line 31 is used as a source pressure so that a boom raising remote control valve (not shown) of the boom control lever device exerts the pilot pressure on an end face pressure receiver of the flow control valve 6*a*. This moves the flow control valve 6*a* to the left indicated in the figure. The hydraulic fluid in a hydraulic fluid supply line 5 from the main pump 2 flows through the flow control valve 6*a* by way of the pressure compensating valve 7*a* and is supplied to the bottom of the boom cylinder 3*a*.

In the above instance, the load pressure of the boom cylinder 3*a* is introduced from the signal hydraulic line 27 to the pressure receiver 15*c* of the unloading valve 15 through the load port 26*a* of the flow control valve 6*a* and through the shuttle valves 9*a*, 9*b*, 9*c*. As the load pressure of the boom cylinder 3*a* is introduced to the pressure receiver 15*c* of the unloading valve 15, the cracking pressure of the unloading valve 15 is set to a pressure obtained by adding the load pressure to the preselected pressure for the spring 15*c* so that the delivery pressure of the main pump 2 rises to a pressure obtained by adding the load pressure and the preselected pressure for the spring 15*c* to the pressure derived from the override characteristics. The pressure sensors 40, 41 detect the resulting delivery pressure of the main pump 2 and the highest load pressure.

As is the case where all the control levers are in neutral position, the controller 50 exercises so-called load sensing control based on the electric motor 1 in accordance with processing functions depicted by the functional block diagram of FIG. 2 by controlling the rotation speed of the electric motor 1 by increasing or decreasing the command signal Vinv for the inverter until the pressure in the second hydraulic fluid supply line 4*a*, that is, the delivery pressure of the main pump 2, is higher than the highest load pressure by the target LS differential pressure PGR. The virtual displacement q* for the load sensing control increases or decreases in accordance with the operation amount of a control lever (demanded flow rate) and varies from the minimum to the maximum due to the limiting process performed by the computation section 50*i*. As a result, the rotation speed of the electric motor 1 (the rotation speed of the main pump 2) also varies from the minimum to the maximum in accordance with the operation amount of a control lever (demanded flow rate).

Meanwhile, when the delivery pressure of the main pump 2 is Pb and Pb<P0 due to light load, the torque control tilt piston 17*a* of the torque control device 17 does not operate so that the displacement of the main pump 2 is at its maximum. An example of the resulting state is represented by point B in FIG. 3.

Here, the maximum rotation speed of the electric motor 1 is the rotation speed prevailing when the virtual displacement q* is qmax. When the maximum rotation speed is Nmax, the following equations are obtained:

$$Qd=q\max\times N0=q\max\times N\max$$

$$N\max=N0$$

More specifically, the resulting actual displacement q of the main pump 2, the virtual displacement q*, and the rotation speed N are expressed by the following equations:

$$q=q\max$$

$$q\min<q^*\leq q\max$$

$$N\min<N\leq N\max$$

$$(N\min<N\leq N0)$$

<Independent Boom Raising (Heavy Load)>

When the load pressure of the boom cylinder 3*a* rises to raise the delivery pressure of the main pump 2 (the pressure in the hydraulic fluid supply line 5) to or above the predetermined pressure P0, which is determined by the springs 17*b*1, 17*b*2 of the torque control device 17, the controller 50 uses the electric motor 1 to exercise load sensing control in the same manner as described under <Independent boom raising (light load)>. In this instance, too, the virtual displacement q* for the load sensing control increases or decreases in accordance with the operation amount of a control lever (demanded flow rate) and varies from the minimum to the maximum, as is the case described under <Independent boom raising (light load)>. Further, the rotation speed of the electric motor 1 (the rotation speed of the main pump 2) also varies from the minimum to the maximum in accordance with the operation amount of a control lever (demanded flow rate).

Meanwhile, as the delivery pressure of the main pump 2 is not lower than the predetermined pressure P0 in the above instance, the torque control tilt piston 17*a* of the torque control device 17 operates so as to decrease the displacement of the main pump 2. Hence, so-called torque limit control is exercised so that the displacement of the main pump 2 decreases with an increase in the delivery pressure of the main pump 2. An example of the resulting state is represented by point C in FIG. 3. The delivery pressure of the main pump 2 is Pc (>P0) and the displacement thereof is qc.

Here, as mentioned earlier, the characteristics curves TP1, TP2 shown in FIG. 3 are set by the springs 17*b*1, 17*b*2. Therefore, the absorption torque of the main pump 2 (the product of pump delivery pressure and displacement), namely, the drive torque of the electric motor 1, is controlled not to exceed the maximum torque (limit torque) TM on the characteristics curves TP1, TP2.

More specifically, the actual displacement q of the main pump 2, the virtual displacement q*, and the rotation speed N are expressed by the following equations:

$$q=qc$$

$$q\text{min}<q^*\leq q\text{max}$$

$$N\text{min}<N\leq N\text{max}$$

$$(N\text{min}<N\leq N0)$$

<Independent Boom Raising (Relief State)>

When, for instance, the boom cylinder 3*a* extends to reach its stroke end, the delivery pressure of the main pump 2 (the pressure in the second hydraulic fluid supply line 4*a*) further rises to reach a preselected pressure for the relief valve 14. When the relief valve 14 actuates, the pressure in the second hydraulic fluid supply line 4*a* is maintained at a level (so-called relief pressure—Pmax) preselected by a spring of the relief valve 14. Further, the load pressure of the boom cylinder 3*a* is introduced into the signal hydraulic line 27 through the load port 26*a* of the flow control valve 6*a*. This load pressure is equal to the above-mentioned relief pressure. In other words, in the resulting state, the pressure in the second hydraulic fluid supply line 4*a* is equal to the pressure in the signal hydraulic line 27 and is also equal to the relief pressure set by the relief valve 14.

Moreover, the detection signal Vps concerning the pressure in the second hydraulic fluid supply line 4*a*, which is generated by the pressure sensor 40, and the detection signal VPLmax concerning the pressure in the signal hydraulic line 27, which is generated by the pressure sensor 41, are introduced into the controller 50. The pressures indicated by these detection signals are equal to each other and also equal to the relief pressure set by the relief valve 14.

In the above instance, the controller 50 increases or decreases the virtual displacement q* of the main pump 2 in such a manner that the pressure in the second hydraulic fluid supply line 4*a* is higher than the pressure in the signal hydraulic line 27 by the target LS differential pressure PGR. In this case, as PLS=Pps−PLmax=0<PGR, ΔP (=PGR−PLS) is a positive value so that the virtual displacement q* of the main pump 2 increases. The minimum displacement qmin and the maximum displacement qmax are set in the computation section 50*i* with respect to the virtual displacement q*. When, for instance, the boom cylinder 3*a* reaches its stroke end, the virtual displacement q* increases to the maximum displacement qmax and is held at the maximum displacement qmax. Therefore, the target flow rate Qd increases to its maximum value, thereby increasing the target rotation speed Nd of the main pump 2 and the command signal Vinv for the inverter 60 to their maximum values, respectively. As a result, the rotation speed of the electric motor 1 is held at the maximum value Nmax, which is equal to the reference rotation speed N0.

Meanwhile, as the delivery pressure of the main pump 2 is not lower than the predetermined pressure P0 in the above instance as well, the torque control tilt piston 17*a* of the torque control device 17 operates to exercise torque limit control for the purpose of reducing the displacement of the main pump 2. The resulting state is represented by point D in FIG. 3. The displacement of the main pump 2 decreases to the minimum displacement qlimit-min due to torque limit control.

More specifically, the resulting actual displacement q of the main pump 2, the virtual displacement q*, and the rotation speed N are expressed by the following equations:

$$q=q\text{limit-min}$$

$$q^*=q\text{max}$$

$$N=N\text{max}=Nd$$

The above-described operations are performed when the boom is manipulated. However, the same operations are also performed when the control lever of a control lever device related to the arm 307 or other work element is manipulated.

~Advantages~

Figure 5B:
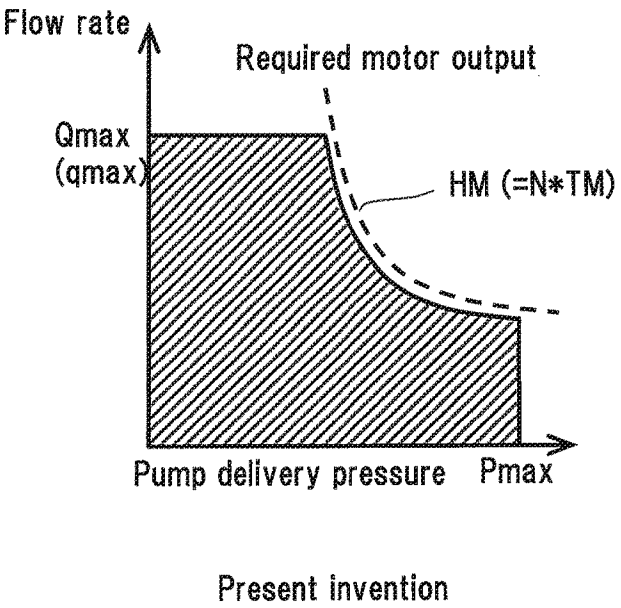
FIG. 5B is a diagram illustrating the horsepower characteristics of the hydraulic drive system according to the first embodiment.
Figure 5A:
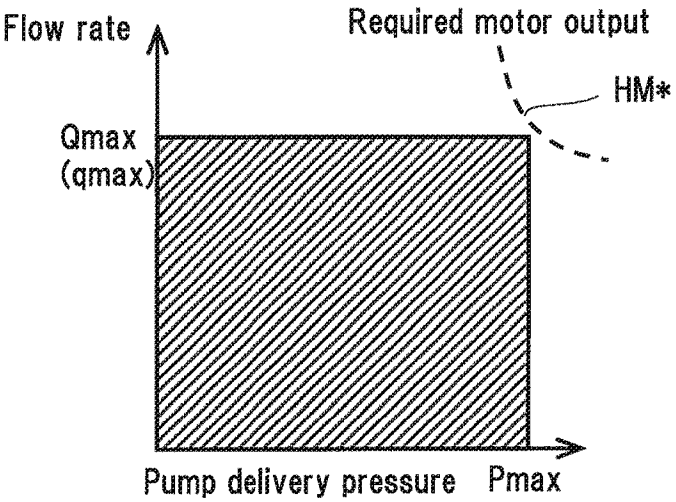
FIG. 5A is a diagram illustrating the horsepower characteristics of a hydraulic drive system that exercises load sensing control by controlling the rotation speed of an electric motor in a prior-art manner.

FIG. 5A is a diagram illustrating the horsepower characteristics of a hydraulic drive system that exercises load sensing control by controlling the rotation speed of an electric motor in a prior-art manner. FIG. 5B is a diagram illustrating the horsepower characteristics of the hydraulic drive system according to the present embodiment. It is assumed that the displacement (fixed) of a fixed displacement hydraulic pump in the prior-art hydraulic drive system is the same qmax as the maximum displacement of the main pump 2 according to the present embodiment shown in FIG. 3.

The prior-art hydraulic drive system, which exercises load sensing control by controlling the rotation speed of an electric motor in the prior-art manner, uses a fixed displacement hydraulic pump. Therefore, when the delivery pressure of the hydraulic pump is at its maximum Pmax, the displacement of the hydraulic pump remains at its maximum qmax. Hence, when load sensing control is exercised to maximize the rotation speed of the electric motor, the delivery rate of the hydraulic pump is at its maximum Qmax so that the horsepower consumption of the hydraulic pump increases to a value that is the product of the maximum delivery pressure Pmax and the maximum delivery rate Qmax (shaded area of FIG. 5A). As a result, the output horsepower of the electric motor increases to HM*, which corresponds to the horsepower consumption of the hydraulic pump, thereby increasing the electrical power consumption of the electric motor. In this instance, the electrical power consumption for cooling the electric motor also increases. This increases the amount of discharge from a battery (electrical storage device), which is an electrical power source for the electric motor. This causes a problem in which the battery rapidly becomes exhausted to shorten the operating time of the work machine.

Further, the output of the electric motor needs to be determined in consideration of the maximum horsepower consumption of the hydraulic pump. This causes another problem in which an electric motor having a high output is required.

The present embodiment, on the other hand, not only exercises load sensing control by controlling the rotation speed of the electric motor, but also includes and uses the torque control device 17 in conjunction with the variable displacement main pump 2 and exercises control, as described under <Independent boom raising (heavy load)> and <Independent boom raising (relief state)>, so that the absorption torque of the main pump does not exceed the maximum torque TM when the delivery pressure of the main pump 2 rises. When torque limit control is exercised over the main pump 2 as described above, the absorption torque of the main pump 2 is maintained at or below the maximum torque TM if the delivery pressure of the main pump 2 rises. Further, control is exercised so that the horsepower consumption of the main pump 2 does not exceed maximum horsepower HM, which is obtained by multiplying the maximum torque TM by the prevailing rotation speed of the main pump 2. As a result, the horsepower consumption of the main pump 2 is suppressed. Hence, the output horsepower of the electric motor 1 is reduced to HM to reduce its electrical power consumption as compared to a case where load sensing control is exercised by controlling the rotation speed of the electric motor in the prior-art manner. This makes it possible to increase the useful life of the battery 70 and prolong the operating time of the electrically-operated hydraulic work machine. Moreover, as the output horsepower of the electric motor 1 is decreased, the size of the electric motor 1 can be reduced.

In addition, the present embodiment introduces a concept of hydraulic pump virtual displacement q* into load sensing control computation sections 50*a*-50*c*, 50*f*-50*h* of the controller 50, determines the target flow rate Qd for load sensing control, and exercises load sensing control by controlling the rotation speed of the electric motor 1. This makes it easy to improve the performance of load sensing control based on rotation speed control of the electric motor 1.

For example, the controller 50 sets the reference rotation speed N0 in accordance with the designation signal Vec of the reference rotation speed designation dial 51, and calculates the target LS differential pressure PGR and the target flow rate Qd in accordance with the magnitude of the reference rotation speed N0.

Consequently, when the operator manipulates the reference rotation speed designation dial 51 to reduce the reference rotation speed N0, the target LS differential pressure PGR and the target flow rate Qd both decrease. As this reduces changes in the rotation speed of the electric motor 1 and decreases the rotation speed of the electric motor 1, an excellent micromanipulation capability is obtained. Further, a control algorithm performing the same functionality as the torque control device 17 can be easily incorporated into the controller 50 as described in conjunction with a second embodiment of the present invention.

Second Embodiment

Figure 6:
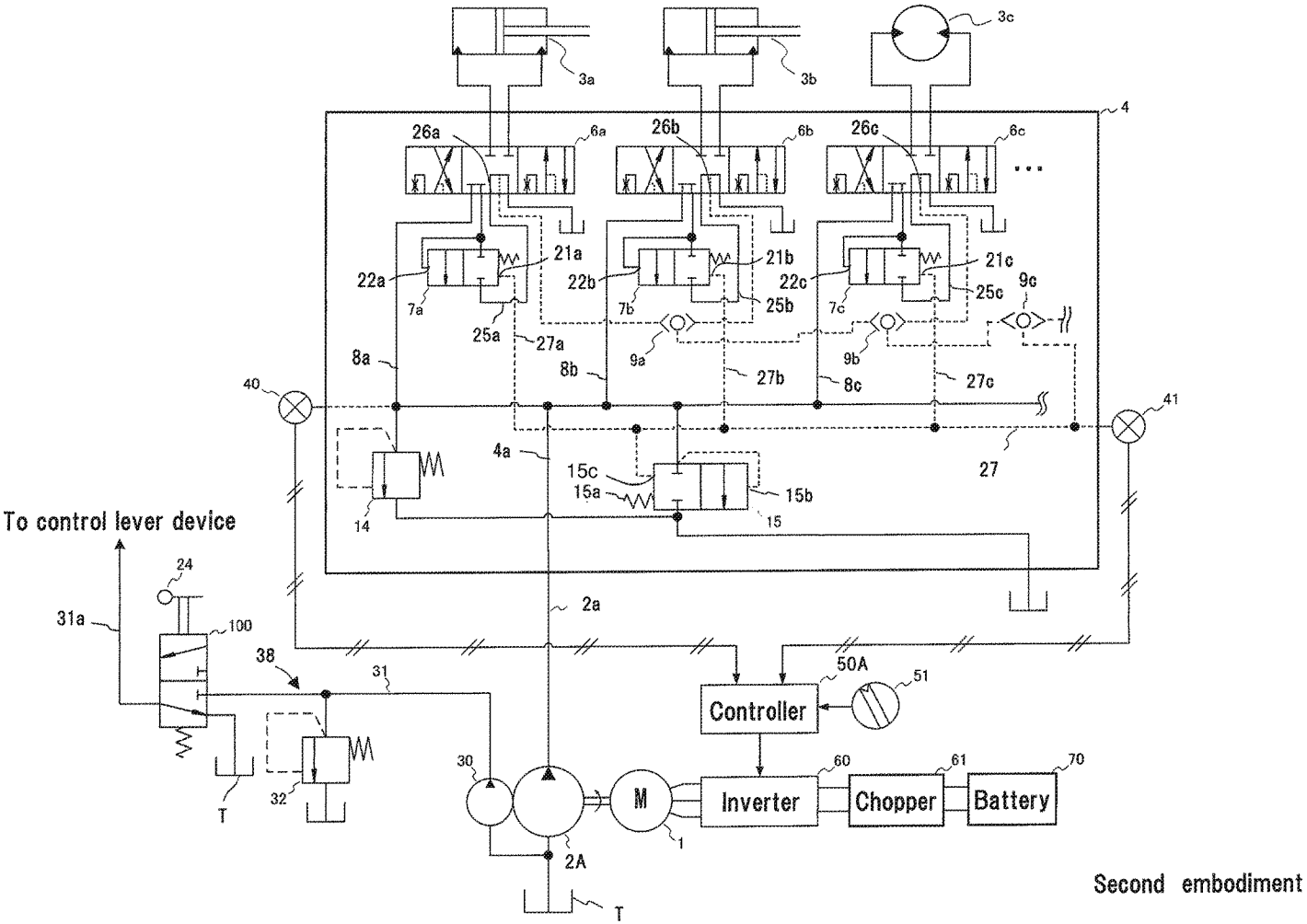
FIG. 6 is a diagram illustrating the configuration of the hydraulic drive system according to a second embodiment of the present invention that is used for an electrically-operated hydraulic work machine.

FIG. 6 is a diagram illustrating the configuration of the hydraulic drive system according to the second embodiment of the present invention that is used for an electrically-operated hydraulic work machine. The second embodiment also relates to a case where the present invention is applied to the hydraulic drive system for a front swing type hydraulic excavator.

~Configuration~

Referring to FIG. 6, the hydraulic drive system according to the present embodiment differs from the hydraulic drive system according to the first embodiment. More specifically, the hydraulic drive system according to the present embodiment uses a main pump 2A, which is of a fixed displacement type. The main pump 2A does not include the torque control device 17 for horsepower control. Further, hydraulic drive system according to the present embodiment uses a controller 50A that has a control function of simulating horsepower control of the main pump 2A (the function of the torque control device).

Figure 7:
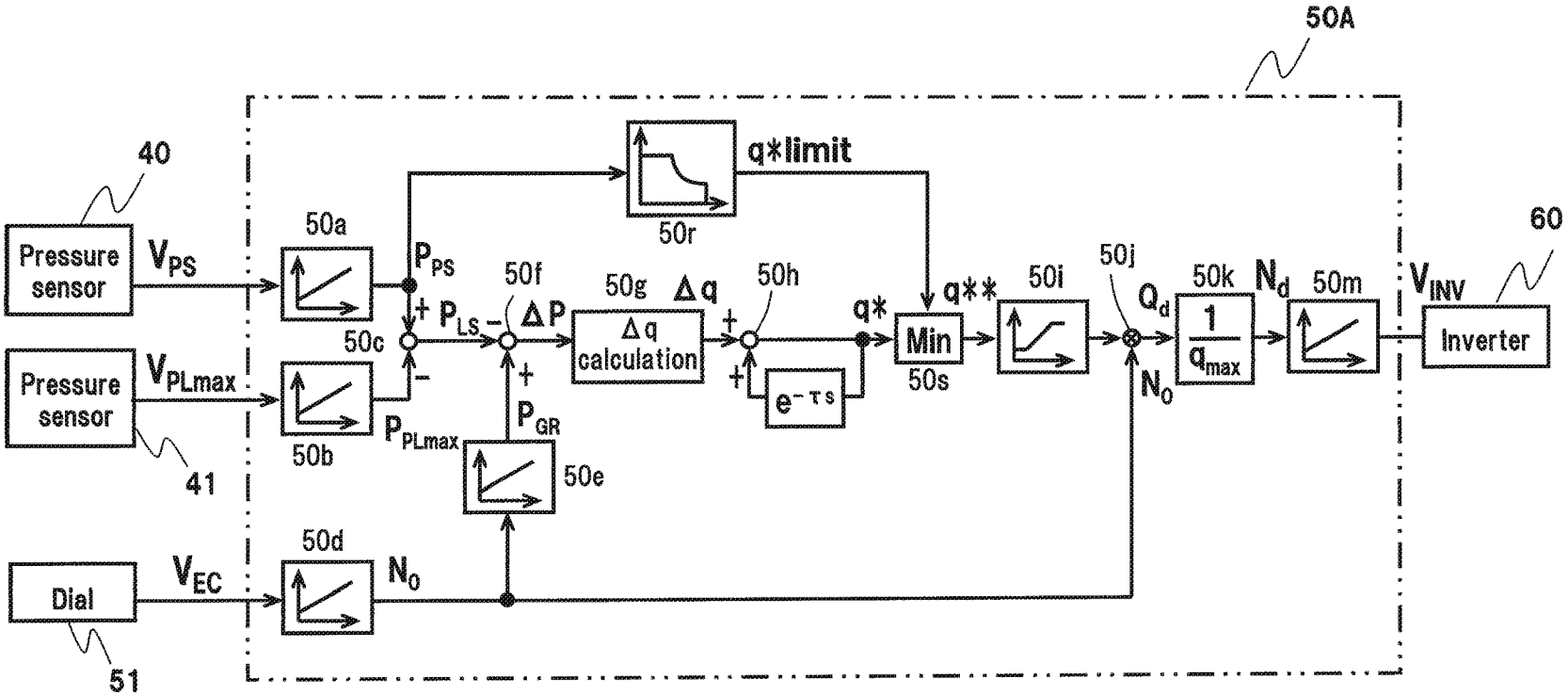
FIG. 7 is a functional block diagram illustrating processes performed by the controller.

FIG. 7 is a functional block diagram illustrating processes performed by the controller 50A.

The controller 50A has a control block that includes computation sections 50*a*-50*h*. The computation sections 50*a*-50*h* compute the virtual displacement q* of the main pump 2A. Computation sections 50*r*, 50*s* are added to the above-described control block so as to reduce the maximum value of the virtual displacement q* in accordance with the delivery pressure of the main pump 2A.

More specifically, the computation section 50*r* has a table in which torque control simulation characteristics are defined. The delivery pressure Pps of the main pump 2A, which is converted by the computation section 50*a*, is input to the computation section 50*r*. The computation section 50*r* references the table and calculates a virtual displacement limit value (maximum virtual displacement) q*limit that corresponds to the delivery pressure Pps of the main pump 2A.

Figure 8:
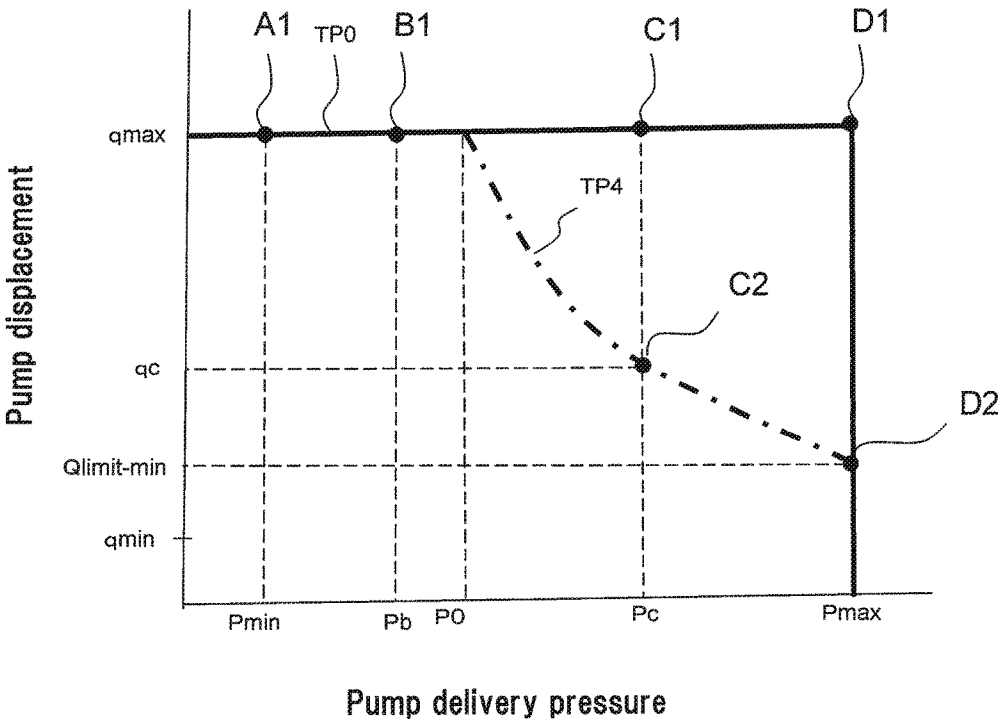
FIG. 8 is a diagram illustrating the torque characteristics of a main pump and characteristics (torque control characteristics) that simulate torque control defined in a computation section.

FIG. 8 is a diagram illustrating the torque characteristics of the main pump 2A and characteristics (torque control characteristics) that simulate torque control defined in the computation section 50*r*.

As the main pump 2A is of a fixed displacement type, the displacement of the main pump 2A remains constant over the whole range of the delivery pressure of the main pump 2A and is equal to the maximum displacement qmax on the characteristics curve TP0.

The torque control characteristics defined in the computation section 50*r* are formed of characteristics corresponding to the maximum displacement characteristics curve TP0 of the main pump 2A, which prevails when the delivery pressure of the main pump 2A is lower than P0, and a constant torque curve TP4, which prevails when the delivery pressure of the main pump 2A is not lower than P0.

As described above, the torque control characteristics are defined in the computation section 50*r*. Therefore, when the delivery pressure Pps of the main pump 2A is low so that Pps<P0, the computation section 50*r* computes q*limit=qmax in accordance with the characteristics curve TP0. When the delivery pressure Pps of the main pump 2A rises so that Pps≥P0, the computation section 50*r* computes q*limit=qlimit in accordance with the constant torque curve TP4.

As described in conjunction with the first embodiment, the computation section 50*h* computes the virtual displacement q* for load sensing control. The computation section 50*s* selects either the virtual displacement q* for the load sensing control computed by the computation section 50*h* or the virtual displacement limit value q*limit determined by the computation section 50*r*, whichever is smaller, and outputs a new virtual displacement q**. Here, a rule for selecting either one of the virtual displacement q* for the load sensing control and the virtual displacement limit value q*limit (e.g., a rule for selecting the virtual displacement q* for the load sensing control) when they are equal should be predefined. The selection of a small value by the computation section 50*s* corresponds to control for reducing the displacement by the torque control device 17 according to the first embodiment in the event of an increase in the delivery pressure of the main pump 2A.

The other processes (the processes performed by the computation sections 50*a*-50*h* and the computation sections 50*i*-50*m*) are the same as those depicted in FIG. 2.

The computation sections 50*r*, 50*s* form a torque limit control computation section that, in accordance with the delivery pressure Pps of the main pump 2A, which is detected by the pressure sensor 40, computes the virtual displacement limit value q*limit that decreases with an increase in the delivery pressure Pps of the main pump 2A, and determine a new virtual displacement q** by selecting either the virtual displacement q* calculated by the load sensing control computation section (computation sections 50*a*-50*c*, 50*f*-50*h*) or the virtual displacement limit value q*limit, whichever is smaller.

~Operations~

Operations of the present embodiment will now be described.

<When the Control Levers are in Neutral Position>

When all the operating devices, including the control levers of the control lever devices 122, 123, 124, are in neutral position, the delivery pressure of the main pump 2A is Pmin, which is equivalent to the preselected pressure for the spring 15*c* of the unloading valve 15, as described under <When the control levers are in neutral position> in conjunction with an exemplary operation according to the first embodiment. The resulting state is represented by point A1 in FIG. 9. In this instance, as mentioned earlier, the differential pressure deviation ΔP (=PGR−PLS) computed by the computation section 50*f* of the controller 50A is a negative value. Thus, the virtual displacement q* for load sensing control decreases.

Meanwhile, the delivery pressure Pps of the main pump 2A, which is determined by the computation section 50*a* of the controller 50A, is Pmin, and Pps<P0 in the computation section 50*r*. Therefore, qmax is calculated as the virtual displacement limit value q*limit from the torque control simulation characteristics.

Here, as q*≤q*limit, the computation section 50*s* selects the virtual displacement q* for the load sensing control computed by the computation section 50*h* and outputs the selection as a new virtual displacement q**.

The subsequent processes to be performed are the same as those described under <When the control levers are in neutral position> in conjunction with the first embodiment.

Here, the virtual displacement q decreases to the minimum displacement qmin due to the limiting process performed by the computation section 50***i*, thereby minimizing the target flow rate Qd, the target rotation speed Nd of the main pump 2A, and the command signal Vinv for the inverter 60. This ensures that the rotation speed of the electric motor 1 and the delivery rate of the main pump 2A are both held at their respective minimum values.

More specifically, the actual displacement q of the main pump 2A, the virtual displacement q*, and the rotation speed N are expressed by the following equations:

$$q=q\max(\text{fixed})$$

$$q^*=q\min$$

$$N=N\min=N0\times(q\min/q\max)$$

<Independent Boom Raising (Light Load)>

When the control lever of a boom control lever device, which is either the control lever device 122 or the control lever device 123, is moved in a boom raising direction to perform a boom raising operation, the virtual displacement q* for the load sensing control computed by the controller 50A increases or decreases in accordance with the operation amount of the control lever (demanded flow rate). If, in this instance, the delivery pressure of the main pump 2A is a pressure Pb represented by point B1 in FIG. 9, the delivery pressure Pps of the main pump 2A, which is determined by the computation section 50*a* of the controller 50A, is lower than P0. Thus, the computation section 50*r* calculates qmax as the virtual displacement limit value q*limit from the torque control simulation characteristics (the characteristics curve TP0 in FIG. 9).

As q*≤q*limit in the above case, too, the computation section 50*s* selects the virtual displacement q for the load sensing control computed by the computation section 50*h* and outputs the selection as a new virtual displacement q**.

The subsequent processes to be performed are the same as those described under <Independent boom raising (light load)> in conjunction with the first embodiment.

Here, the virtual displacement q increases or decreases in accordance with the operation amount of a control lever (demanded flow rate) and varies from the minimum to the maximum due to the limiting process performed by the computation section 50***i*. As a result, the rotation speed of the electric motor 1 (the rotation speed of the main pump 2A) also varies from the minimum to the maximum in accordance with the operation amount of the control lever (demanded flow rate).

More specifically, the resulting actual displacement q of the main pump 2A, the virtual displacement q*, and the rotation speed N are expressed by the following equations:

$$q=q\max(\text{fixed})$$

$$q\min<q^{**}\leq q\max$$

$$N\min<N\leq N\max$$

$$(N\min<N\leq N0)$$

<Independent Boom Raising (Heavy Load)>

In a heavy-load state in which the load pressure of the boom cylinder 3*a* rises, the virtual displacement q* for the load sensing control computed by the controller 50A also increases or decreases in accordance with the operation amount of a control lever (demanded flow rate). If, in this instance, the delivery pressure of the main pump 2A is the pressure Pb represented by point C1 in FIG. 9, the delivery pressure Pps of the main pump 2A, which is determined by the computation section 50*a* of the controller 50A, is higher than P0. Thus, the computation section 50*r* calculates qlimit (<qmax) as the virtual displacement limit value q*limit from the torque control simulation characteristics (the constant torque curve TP4 in FIG. 9). The relevant position on the constant torque curve TP4 is represented by point C2 in FIG. 9. At point C2, q*limit=qc.

The computation section 50*s* selects either the virtual displacement q* or the virtual displacement limit value q*limit, whichever is smaller, and outputs the selection as a new virtual displacement q. More specifically, the computation section 50***s* selects q* when q* q*limit or selects q*limit when q*>q*limit, and outputs the selection as the new virtual displacement q**.

Subsequent processes to be performed are the same as those described under <Independent boom raising (heavy load)> in conjunction with the first embodiment.

Here, the virtual displacement q** is limited to q*limit. Thus, the target flow rate Qd, the target rotation speed Nd of the main pump 2A, and the command signal Vinv for the inverter 60 are similarly limited to limit the rotation speed of the electric motor 1.

As described above, the controller 50 has the same functionality as the torque control device 17 according to the first embodiment and exercises control to prevent the absorption torque of the main pump 2A from exceeding the maximum torque (limit torque) TM.

If, in the above instance, the rotation speed corresponding to the virtual displacement limit value q*limit is Nlimit, the actual displacement q of the main pump 2A, the virtual displacement q**, and the rotation speed N are expressed by the following equations:

$$q=q\text{max(fixed)}$$

$$q\text{min}<q^{**}\leq q\text{limit}$$

$$N\text{min}<N\leq N\text{limit}$$

<Independent Boom Raising (Relief State)>

When, for instance, the boom cylinder 3*a* extends to reach its stroke end, the delivery pressure of the main pump 2 is held at the relief pressure Pmax with the highest load pressure being equal to the relief pressure, as mentioned earlier. The resulting state is represented by point D1 in FIG. 9. In this instance, as mentioned earlier, the differential pressure deviation ΔP (=PGR−PLS) computed by the computation section 50*f* of the controller 50A is a positive value. Thus, the virtual displacement q* for load sensing control increases.

Meanwhile, the delivery pressure Pps of the main pump 2A, which is determined by the computation section 50*a* of the controller 50A, is Pmax. Thus, the computation section 50*r* calculates qlimit-min, which is at point D2 in FIG. 9, as the virtual displacement limit value q*limit from the torque control simulation characteristics (the constant torque curve TP4 in FIG. 9). As q*>q*limit, the computation section 50*s* selects the virtual displacement limit value q*limit computed by the computation section 50*r* and outputs the selection as a new virtual displacement q**.

Subsequent processes to be performed are the same as those described under <Independent boom raising (relief state)>.

Here, the virtual displacement q** is limited to q*limit-min. Thus, the target flow rate Qd, the target rotation speed Nd of the main pump 2A, and the command signal Vinv for the inverter 60 are similarly limited to limit the rotation speed of the electric motor 1.

Consequently, control is also exercised in the above instance so as to prevent the absorption torque of the main pump 2A from exceeding the maximum torque (limit torque) TM.

If, in the above instance, the rotation speed corresponding to q*limit-min is Nlimit-min, the actual displacement q of the main pump 2A, the virtual displacement q**, and the rotation speed N are expressed by the following equations:

$$q=q\text{max(fixed)}$$

$$q=q\text{limit-min}$$

$$N=N\text{limit-min}$$

The above-described operations are performed when the boom is manipulated. However, the same operations are also performed when the control lever of a control lever device related to the arm 307 or other work element is manipulated.

~Advantages~

As is the case with the first embodiment, the present embodiment exercises control to prevent the absorption torque of the main pump 2A from exceeding the maximum torque TM and prevent the horsepower consumption of the main pump 2A from exceeding the maximum horsepower HM, which is obtained by multiplying the maximum torque TM by the prevailing rotation speed of the main pump 2A. As a result, the horsepower consumption of the main pump 2A is suppressed. Hence, the output horsepower of the electric motor 1 is reduced to HM to reduce its electrical power consumption as compared to a case where load sensing control is exercised by controlling the rotation speed of the electric motor in the prior-art manner. This makes it possible to increase the useful life of the battery 70 and prolong the operating time of the electrically-operated hydraulic work machine. Moreover, as the output horsepower of the electric motor 1 is decreased, the size of the electric motor 1 can be reduced.

Further, as the main pump 2A is of a fixed displacement type, the present embodiment makes it possible to reduce the size of the main pump 2A, thereby conserving space.

<Other>

The foregoing embodiments may be variously modified within the spirit and scope of the present invention. In the foregoing embodiments, the pressure compensating valves 7*a*, 7*b*, 7*c*, . . . are of a postposed type, positioned downstream of the meter-in throttle section of the flow control valves 6*a*, 6*b*, 6*c*, . . . , and used to control the downstream pressures of all the flow control valves 6*a*, 6*b*, 6*c*, . . . at the same maximum load pressure for the purpose of equalizing the differential pressures across the flow control valves 6*a*, 6*b*, 6*c*, . . . . Alternatively, however, the pressure compensating valves 7*a*, 7*b*, 7*c*, . . . may be of a preposed type, positioned upstream of the meter-in throttle section of the flow control valves 6*a*, 6*b*, 6*c*, . . . , and used to control the differential pressure across the meter-in throttle section at a preselected value.

Further, the foregoing embodiments have been described on the assumption that a hydraulic excavator is used as the work machine. However, even when the present invention is applied to a construction machine (e.g., a hydraulic crane or a wheel excavator) other than a hydraulic excavator, the same advantages are obtained as far as it is a work machine that drives a plurality of actuators in accordance with a fluid discharged from the main pump.

DESCRIPTION OF REFERENCE NUMERALS

1 Electric motor
2, 2A Hydraulic pump (main pump)
2*a* First hydraulic fluid supply line
3*a*, 3*b*, 3*c*, . . . Actuator
4 Control valve
4*a* Second hydraulic fluid supply line
6*a*, 6*b*, 6*c*, . . . Flow control valve
7*a*, 7*b*, 7*c*, . . . Pressure compensating valve
8*a*, 8*b*, 8*c*, . . . Hydraulic line
9*a*, 9*b*, 9*c*, . . . Shuttle valve
14 Main relief valve
15 Unloading valve
15*a* Spring
15*b* Pressure receiver operable in opening direction
15*c* Pressure receiver operable in closing direction
17 Torque control device
17*a* Torque control tilt piston
17*b*1, 17*b*2 Spring

21*a*, 21*b*, 21*c*, . . . Pressure receiver operable in closing direction
22*a*, 22*b*, 22*c*, . . . Pressure receiver operable in opening direction
24 Gate lock lever
25*a*, 25*b*, 25*c*, . . . Hydraulic line
26*a*, 26*b*, 26*c*, . . . Load port
27, 27*a*, 27*b*, 27*c*, . . . Signal hydraulic line
30 Pilot pump
31, 31*a* Pilot hydraulic line
32 Pilot relief valve
38 Pilot hydraulic fluid source
40, 41 Pressure sensor
50, 50A Controller
50*a*-50*m* Computation section
50*r*, 50*s* Computation section
51 Reference rotation speed designation dial
60 Inverter
61 Chopper
70 Battery
100 Gate lock valve
122, 123 Control lever device
q* Virtual displacement
q*limit Virtual displacement limit value
TP1, TP2 Torque control characteristics curve
TP4 Constant torque curve

The invention claimed is:

1. A hydraulic drive system for an electrically-operated hydraulic work machine, the work machine having
an electric motor,
a hydraulic pump driven by the electric motor,
a plurality of actuators driven by a hydraulic fluid discharged from the hydraulic pump,
a plurality of flow control valves configured to control a flow rate of the hydraulic fluid supplied from the hydraulic pump to the actuators,
an electrical storage device configured to supply electrical power to the electric motor,
an electric motor rotation speed control system configured to control a rotation speed of the electric motor, and
a torque control device configured to control an absorption torque of the hydraulic pump,
wherein the electric motor rotation speed control system is configured to control the rotation speed of the electric motor in such a manner that a delivery pressure of the hydraulic pump is higher than a highest load pressure of the actuators by a target differential pressure when the electric motor is driven to drive the hydraulic pump, and
the torque control device is configured to control the absorption torque of the hydraulic pump in such a manner that the absorption torque of the hydraulic pump does not exceed a predefined maximum torque by decreasing a delivery rate of the hydraulic pump when the delivery pressure of the hydraulic pump driven by the electric motor increases,
wherein the electric motor rotation speed control system includes:
a first pressure sensor to detect the delivery pressure of the hydraulic pump,
a second pressure sensor to detect the highest load pressure,
an inverter configured to control the rotation speed of the electric motor, and
a controller configured to:
compute a virtual displacement of the hydraulic pump, which increases or decreases depending on whether a differential pressure deviation is positive or negative, wherein the differential pressure deviation is a difference between the target differential pressure and a difference pressure, which is a difference between the delivery pressure of the hydraulic pump and the highest load pressure of the actuators which are detected by the first pressure sensor and the second pressure sensor,
compute a target flow rate of the hydraulic pump by multiplying the virtual displacement by a reference rotation speed, and
output a control command to the inverter to control the rotation speed of the electric motor in such a manner that the delivery rate of the hydraulic pump agrees with the target flow rate.

2. The hydraulic drive system according to claim 1,
wherein the torque control device is one function of the controller incorporated in the controller.

3. The hydraulic drive system according to claim 2,
wherein the controller is further configured to:
compute, in accordance with the delivery pressure of the hydraulic pump detected by the first pressure sensor, a virtual displacement limit value that decreases with an increase in the delivery pressure of the hydraulic pump,
determine a new virtual displacement by selecting the smaller of the computer virtual displacement and the virtual displacement limit value, and
compute the target flow rate of the hydraulic pump by multiplying the new virtual displacement by the reference rotation speed.

4. The hydraulic drive system according to claim 3,
wherein the controller is further configured to:
set the reference rotation speed in accordance with a command signal from an operating device that instructs the reference rotation speed, and
compute the target differential pressure and the target flow rate in accordance with the reference rotation speed.

5. The hydraulic drive system according to claim 1,
wherein the torque control device is a regulator incorporated in the hydraulic pump.

* * * * *